US005174862A

United States Patent [19]

Hale et al.

[11] Patent Number: 5,174,862

[45] Date of Patent: * Dec. 29, 1992

[54] POLISHING DOCTOR BLADE WITH DIAMOND ABRASIVE PARTICLES FOR A CALENDERING ROLL

[75] Inventors: Gregory H. Hale, Waterville; Abbott W. Mosher, Gorham; John O. H. Peterson, Standish; Douglas A. Quist, Kennebunk, all of Me.

[73] Assignee: S. D. Warren Company, Westbrook, Me.

[ * ] Notice: The portion of the term of this patent subsequent to Dec. 15, 2009 has been disclaimed.

[21] Appl. No.: 620,248

[22] Filed: Nov. 30, 1990

[51] Int. Cl.[5] ..... D21G 3/00

[52] U.S. Cl. ..... 162/272; 162/281; 162/375; 100/174; 165/91

[58] Field of Search ..... 162/361, 281, 206, 375, 162/272; 15/256.51; 165/91; 100/174; 51/5 D, 211 R, 211 H

[56] References Cited

U.S. PATENT DOCUMENTS

| | | | |
|---|---|---|---|
| 3,014,833 | 12/1961 | Lee | 15/256.51 |
| 3,065,486 | 11/1962 | Scott | 15/256.51 |
| 3,869,344 | 4/1975 | Hunt | 162/281 |
| 4,324,613 | 4/1982 | Wahren | 162/206 |

FOREIGN PATENT DOCUMENTS 1-150667 6/1989 Japan .

OTHER PUBLICATIONS

Nakahira "Unusual Application by Jet Kote" (no publication date).

*Primary Examiner*—Karen M. Hastings

*Attorney, Agent, or Firm*—R. Duke Vickrey; Frank M. DiBiase; John W. Kane, Jr.

[57] ABSTRACT

Disclosed is a polishing doctor blade for resurfacing the surface of a metal calendering roll while in operation, comprising a working surface containing diamond abrasive particles harder than the surface material.

3 Claims, 2 Drawing Sheets

POLISHING DOCTOR BLADE WITH DIAMOND ABRASIVE PARTICLES FOR A CALENDERING ROLL

TECHNICAL FIELD

The invention relates generally to processes and equipment for the manufacture of printing paper, and in particular, to a doctor blade for polishing a calender roll for calendering printing paper.

BACKGROUND ART

One of the most important steps in the manufacture of high quality printing papers, coated or uncoated, is the calendering of the paper web to impart gloss and smoothness to its surface. A number of different processes exist for calendering paper. One long used for producing the highest quality product is supercalendering. Gloss calendering is another process, which while not producing the quality of supercalendering, does have process advantages over supercalendering. Substrata thermal molding is a recently developed calendering process which combines process advantages of gloss calendering with the quality advantages of supercalendering. Substrata thermal molding is described in U.S. Pat. Nos. 4,624,744 and 4,749,445, which patents are hereby incorporated by reference.

In both gloss calendering and substrata thermal molding the outer surface of the heated calender roll must have a hard highly polished surface. The roll drum is traditionally made from chilled iron, ductile iron or chrome plated ductile iron, which provides a hard, abrasion resistant surface which takes and holds a high polish. More recently developed heated rolls include metal rolls coated with a thin layer of very hard materials, such as carbide containing materials. These recently employed surface materials deteriorate when faced with abrasive paper coating materials, the abrasive action of a cleaning doctor blade, and a corrosive environment. They must be resurfaced periodically and it would be preferably to do so while in operation.

DISCLOSURE OF THE INVENTION

The invention is a polishing doctor blade for positioning against the circumferential surface of a metal calendering roll to resurface the roll while in operation faster than it deteriorates, the polishing doctor having a working surface containing an abrasive material harder than the surface material, preferably diamond abrasive particles. The doctor blade preferably comprises a thin structure of high glass transition temperature epoxy material. The working surface includes a layer of the polishing composition extending across the width of the doctor blade. The composition comprises abrasive particles harder than the metal surface of the calendering roll and in a matrix of high temperature epoxy.

The invention is also an improvement to a calendering process and apparatus for providing a smooth surface to paper, which apparatus comprises:

A. a metal calendering roll;

B. a resilient pressure roll;

C. means to press the resilient pressure roll and the metal calendering roll against each other to form a nip;

D. means to continuously pass a web of paper through the nip;

E. means to provide heat to the surface of the metal calendering roll; and

F. the polishing doctor blade described above positioned against the metal calendering roll for resurfacing the surface of a metal calendering roll while in operation.

BEST MODE FOR CARRYING OUT THE INVENTION

Figure 1:
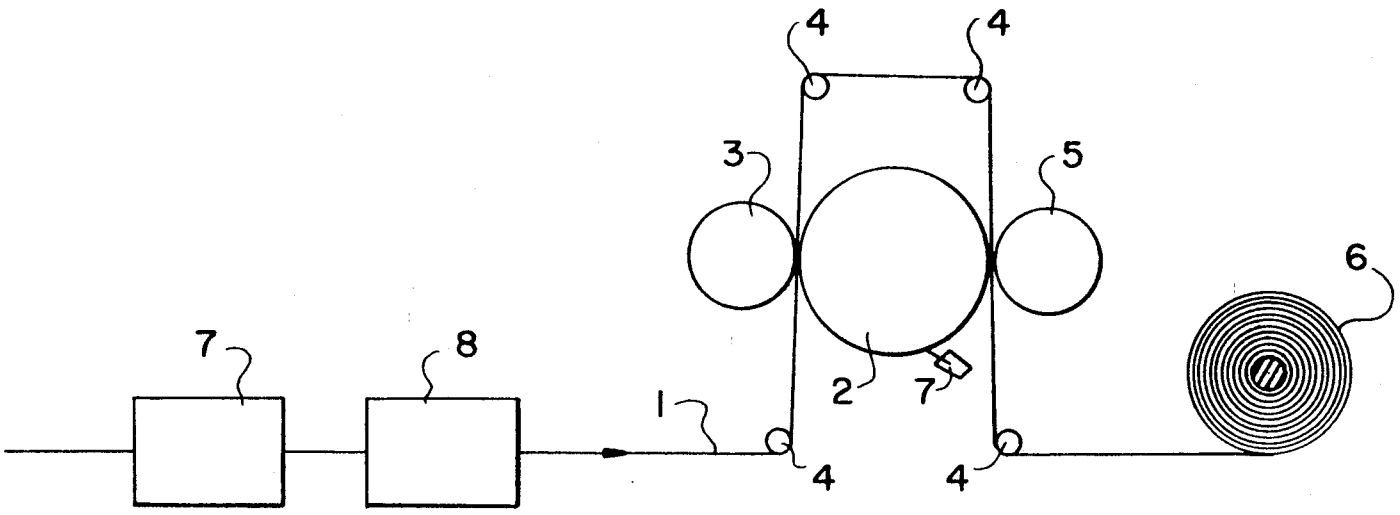
FIG. 1 illustrates in schematic form a calendering apparatus suitable for employing the invention.

The present invention can be carried out on an apparatus like that illustrated in FIG. 1. A paper web 1 is advanced through the first nip formed by smooth surface finishing drum 2 and resilient backing roll 3, around guide rolls 4, and through an optional second nip formed by roll 2 and resilient backing roll 5. Thereafter, if desired to finish the other side of web 1, it is advanced to a second smooth surface finishing drum (not illustrated for simplicity) with a pair of nips formed by resilient backing rolls similar to the first unit. The finished web is then wound onto reel 6.

The web 1 supplied to the finishing apparatus can come directly from a papermaking machine 7 and/or coater 8 if the paper is to be coated. In the alternative, the web 1 can be supplied from a roll of previously manufactured paper which may or may not have already been coated. The papermaking machine and coater are illustrated only as blocks since they can be provided by any conventional apparatus well known in the art.

The heated calendering roll 2 is constructed from a metal cylinder with a hard outer surface. Examples of such surfaces are carbide containing materials layered upon a steel or cast iron roll.

In a relatively short period of time commercial usage of metal calendering rolls will result in a hazing of the surface due to some combination of surface deterioration causes. To restore the surface, the surface must be polished at intervals depending upon the durability of the material. Polishing can be carried out while the heated roll is in operation by doctor blade 7 positioned against calendering roll 2 in FIG. 1.

Figure 2:
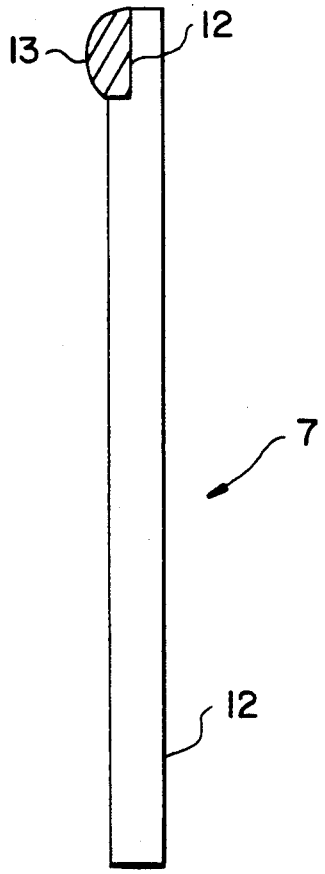
FIG. 2 is a sectional view the preferred form of polishing doctor of the present invention.

The preferred form of doctor blade 7 is disclosed in more detail in FIG. 2. It consists of a wide glass fiber reinforced epoxy material 12 with a layer 13 of abrasive composition at the working edge of the blade 7. The layer is preferably placed in a notch 12 of the blade 7 and is thick enough to extend at least even or beyond the blade 7 to assure contact with the roll surface 11. The preferred form of doctor blade 7 of the invention will polish the roll surface of very hard materials and will withstand continuous use a very high roll surface temperatures, such as necessary to practice substrata thermal molding.

The preferred polishing composition is:

| | |
|---|---|
| Diamond abrasive particles, 3 microns dia. | 2.5% by weight |
| Epoxy with hardener | 52.5% by weight |
| Hollow glass microspheres, (3M S-60/10,000) | 30% by weight |
| Teflon (polytetrafluoroethylene) powder (Diamond Shamrock SST-3) | 15% by weight |

The abrasive composition was spread into a notch in the epoxy blade and heated to 60° C. to 70° C. until set. It was then heated at 120° C. for 4 hours. The epoxy used was diglycidyl ether of bispheno A with a hardener of methylene dianiture with a Tg of 160° C. to 180° C. The ratio of abrasive particles is believed to be satisfactory from about 1% to about 5% of the composition. The size of the particles can be varied somewhat, but is preferably between 2 and 12 microns. The epoxy employed for making the base blade is the same as the used for the abrasive composition, but in the blade it is reinforced with fiberglass woven mats. The surface of abrasive composition after curing was milled smooth down to a thickness of about 25 mils.

The polishing doctor does not have to be in constant contact with the roll surface, but should be pressed against the roll for about 10% of the time.

The polishing doctor was pressed against the surface of a carbide containing surfaced roll at a pressure of 1 pli and at an angle of 25° to the tangent of the roll while the roll was operated. The roll ran cleanly over a prolonged period of time and produced coated paper of desired gloss and smoothness.

What is claimed is:

1. In a calendering apparatus for providing a smooth surface to paper, which apparatus comprises:

A. a metal calendering roll coated with a thin layer of carbide containing materials which deteriorate when faced with abrasive paper coating materials, the abrasive action of a cleaning doctor blade, and a corrosive environment and must be resurfaced periodically;

B. a resilient pressure roll;

C. means to press the resilient pressure roll and the metal calendering roll against each other to form a nip;

D. means to continuously pass a web of paper through the nip; and

E. means to provide heat to the surface of the metal calendering roll, the improvement which comprises a polishing doctor blade positioned against the circumferential surface of the metal calendering roll to resurface the roll while in operation, comprising a working surface containing diamond abrasive particles.

2. The calendering apparatus of claim 1, wherein the diamond abrasive particles are of a size between 2 and 12 microns in a hardened epoxy matrix with the diamond abrasive particles comprising between 1% and 5% of the working surface composition.

3. The calendering apparatus of claim 2, wherein the working surface of the polishing doctor blade further comprises hollow glass microspheres and polytetrafluoroethylene powder.

* * * * *